US009004712B1

(12) United States Patent
Bass

(10) Patent No.: US 9,004,712 B1
(45) Date of Patent: Apr. 14, 2015

(54) CONVERTIBLE SAFETY BODY COVER

(71) Applicant: Thomas R. Bass, Little Egg Harbor, NJ (US)

(72) Inventor: Thomas R. Bass, Little Egg Harbor, NJ (US)

( * ) Notice: Subject to any disclaimer, the term of this patent is extended or adjusted under 35 U.S.C. 154(b) by 0 days.

(21) Appl. No.: 14/173,303

(22) Filed: Feb. 5, 2014

(51) Int. Cl.
*F21V 21/108* (2006.01)
*F21V 33/00* (2006.01)

(52) U.S. Cl.
CPC ..... *F21V 33/0076* (2013.01)

(58) Field of Classification Search
CPC ... A41D 13/01; A41D 1/0036; F21Y 2101/02
USPC ..... 362/103, 108; 2/102, 301
See application file for complete search history.

(56) References Cited

U.S. PATENT DOCUMENTS 2,651,866 A * 9/1953 Tuttle ..... 40/573
4,328,533 A * 5/1982 Paredes ..... 362/108
5,226,192 A * 7/1993 Jones et al. ..... 2/461
5,249,106 A 9/1993 Barnes et al.
5,690,411 A * 11/1997 Jackman ..... 362/103
5,984,488 A 11/1999 Tung
6,267,482 B1 * 7/2001 Miller et al. ..... 362/103
6,820,280 B1 * 11/2004 Atallah et al. ..... 2/102
6,991,343 B2 * 1/2006 Langley et al. ..... 362/108
6,997,573 B2 * 2/2006 Maese ..... 362/84
7,259,691 B2 * 8/2007 Kimbrough, Jr. ..... 340/907
2006/0034064 A1 2/2006 Kanzler et al.
2009/0154135 A1 * 6/2009 Fong ..... 362/16
2013/0126397 A1 * 5/2013 Ghosh ..... 209/363
2013/0201670 A1 * 8/2013 Pickard et al. ..... 362/184
2013/0255116 A1 * 10/2013 Kaoh ..... 40/563

* cited by examiner

*Primary Examiner* — Ali Alavi
(74) *Attorney, Agent, or Firm* — Michael R. Philips

(57) ABSTRACT

The invention disclosed provides a convertible safety body cover with interchangeable light patterns. The safety body cover has an outer front panel permanently connected to an outer rear panel. A first light pattern is mounted to an inner front panel that is removeably mounted to the outer front panel. A second light pattern is mounted to an inner rear panel that is removeably mounted to the outer rear panel. The light pattern panels are removed and replaced with different light pattern panels to create different visual effects.

7 Claims, 3 Drawing Sheets

CONVERTIBLE SAFETY BODY COVER

FIELD OF THE INVENTION

The present invention relates to the field of illuminated safety garments, and more particularly to a safety body cover having an interchangeable light pattern.

BACKGROUND OF THE INVENTION

A safety vest, or body cover, is typically a light weight garment that is highly visible and intended to be worn to insure the wearer is visible to a driver of a vehicle. Safety vests are worn by workers involved in road construction and by persons exercising on roads used by vehicles. At times when ambient illumination is low, e.g. early mornings, late afternoons, evenings and in situations when visibility is minimal, e.g. during a fog, safety vests with lights are sometimes used. Examples of known safety vests with lights are disclosed in U.S. Pat. No. 5,984,488, U.S. Pat. No. 5,249,106, and U.S. Published Patent Application No. 2006/0034064.

While the above listed inventions provide safety vests with lighting apparatus, a problem persists in that the vests are not used regularly by persons exercising on roads used by vehicles. This lapse results in many unnecessary accidents because the exerciser is often not seen by the vehicle driver in time to avoid injury. Construction workers involved in road projects wear safety vests more regularly, possibly because of insurance requirements or governmental regulations. It remains a problem to motivate exercisers to wear a safety vest, especially a lighted safety vest during times of low ambient light.

SUMMARY OF THE INVENTION

The present invention provides a novel safety body cover that is designed to encourage greater use by persons exercising on roads in low light conditions. The body cover is formed with an outer panel and an inner panel at the front and the rear portions. The outer panels are semi-transparent. The inner panels carry a lighted pattern that is connected to a power supply. The inner panels are removably connected to the outer panels. The user can choose an inner panel with a preferred light pattern, or convert the body cover by replacing one inner panel with another inner panel having a different light pattern. It is anticipated that the selection of light pattern, or the changeability of light pattern, will motivate persons exercising on a road in low light conditions to more consistently wear such a lighted safety body cover.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENT

Figure 1:
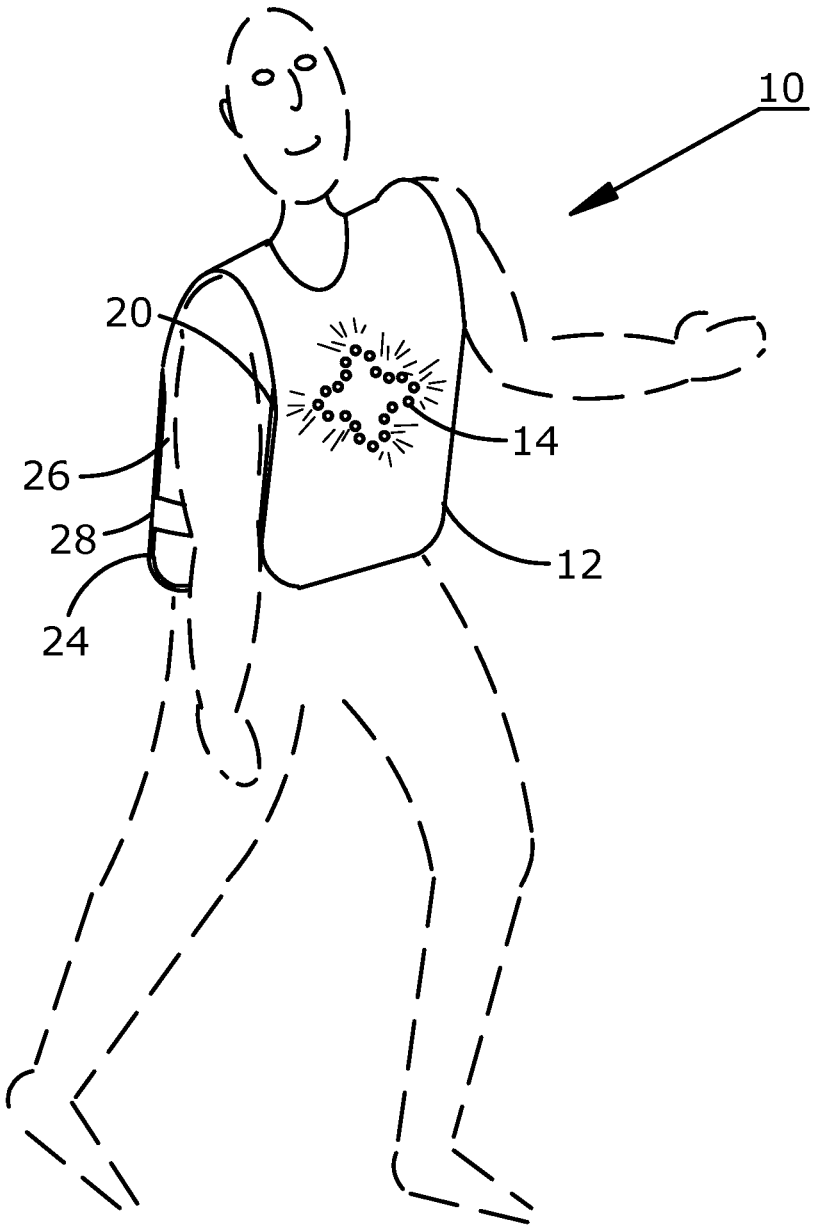
FIG. 1 is a front perspective view of a convertible safety body cover of the invention being worn with a first light pattern installed and illuminated.

Referring to FIG. 1, the convertible safety body cover 10 of the invention is illustrated being worn by a person doing exercise, the person shown in dashed lines. Body cover 10 has an outer front panel 12 and an inner front panel 20 removably mounted thereto. A light pattern 14 is mounted to inner front panel 20 and is seen being illuminated through outer front panel 12. A power supply, to be described below, is provided to illuminate light pattern 14.

Referring further to FIG. 1, body cover 10 has an outer rear panel 24 that is integral with, or permanently assembled to, outer front panel 12, a neck hole being provided substantially between outer front panel 12 and outer rear panel 24. An inner rear panel 26 is removably mounted to outer rear panel 24. A closure means 28, e.g. a strap or a pair of snap fasteners, is provided to hold the front and rear panels of body cover 10 close to the body of the person during exercise.

Referring further to FIG. 1, light pattern 14 is formed of an array of LEDs that are electrically energized, or optionally of a continuous light tube. Light pattern 14 is illustrated in the form of a stylized star pattern. A further light pattern (not shown) is mounted to inner rear panel 26, the rear light pattern optionally being like or different from the front light pattern in shape and color. According to the main objective of the invention, alternate patterns may be formed to allow the user to choose a style according to personal preference and to convert body cover 10 by changing patterns as desired. The light patterns may be of different shapes, including initials, words, letters, designs, etc. and/or of different colors. As noted above, this convertibility and the availability of varied light patterns is intended to increase use of the subject safety body cover by persons exercising on a road in low light conditions. Outer front panel 12 and outer rear panel 24 are preferably formed of a lightweight fabric that is semi-transparent to make light pattern 14 and the rear light pattern (not shown) clearly visible when energized. Alternately, outer front panel 12 and outer rear panel 24 may be formed of a translucent plastic resin.

Figure 2:
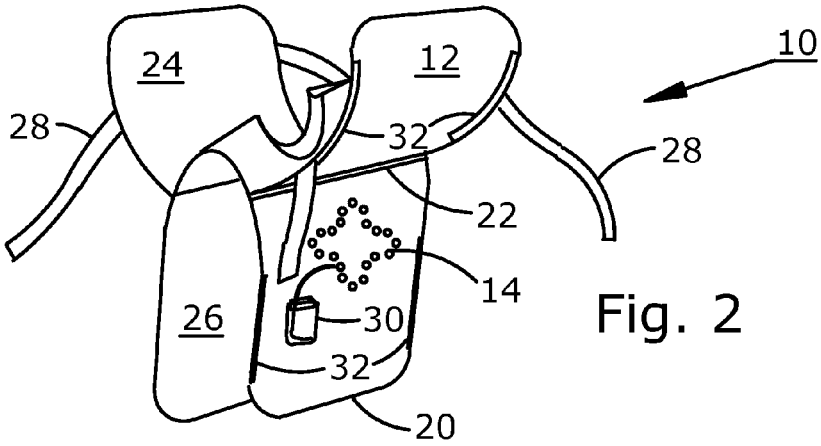
FIG. 2 is a perspective view of the safety body cover of FIG. 1 with the front outer panel and the rear outer panel lifted to expose the front inner panel and the rear inner panel.

Referring now to FIG. 2, convertible safety body cover 10 is shown with outer front panel 12 and outer rear panel 24 lifted upwardly. Inner front panel 20 and inner rear panel 26 are seen hanging downwardly. Light pattern 14 is mounted to the forward facing surface of inner front panel 20. A power supply 30, e.g. a battery with a switch attached, is mounted to inner front panel 20 and connected to light pattern 14. A second light pattern (not shown) and a second power supply are mounted to the rearward facing surface of inner rear panel 26. In use, a top fastener 22 and a pair of side fasteners 32 that are mounted to the inner surface of outer front panel 12 and the outer surface of inner front panel 20 serve to hold inner front panel 20 to outer front panel 12. Fasteners 22, 32 may be zippers, snap fasteners, hook-and-loop fasteners (e.g. Velcro®), or any other fastener appropriate to the purpose. Straps 28 are shown in the untied condition hanging from respective panels. Optionally, straps 28 may be fitted with buckles, snap fasteners, hook-and-loop fasteners, or left plain to be tied to one another.

Figure 3A:
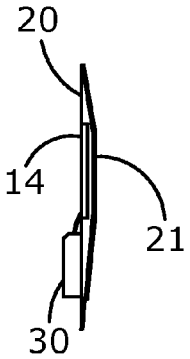
FIG. 3A is a side view of the front inner panel of FIG. 3 taken in the direction of line A-A.
Figure 3:
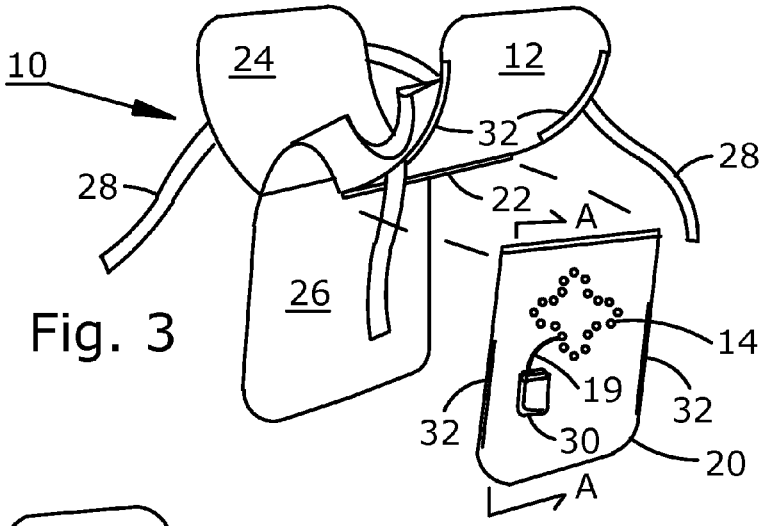
FIG. 3 is a front perspective view of the safety body cover of FIG. 2 with the front inner panel removed.

Referring now to FIG. 3, body cover 10 is illustrated in similar condition to the condition of FIG. 2. At this stage, inner front panel 20 has been separated from outer front panel 12 in order to be replaced with a different inner front panel having a different light pattern. It will be understood that substitute inner front panels and inner rear panels are to be produced in identical dimensions with top fastener 22 and side fasteners 32 in matching positions. In the preferred embodiment of the invention, light pattern 14 is mounted to a flexible sheet 20, e.g. a vinyl plastic sheet.

Referring now to FIG. 3A, inner front panel 20 is shown in lateral edge view. Light pattern 14 and power supply 30 are mounted to inner front panel 20. A second flexible sheet 21 is mounted over inner front panel 20 as added protection for light pattern 14, second sheet 21 being transparent. Second sheet 21 is preferably sealed to inner front panel 20 at their mutual periphery, e.g. by adhesive or thermal means. A similar protective transparent sheet is mounted to inner rear panel 26 (see FIG. 3) to protect the light pattern mounted thereto.

Figure 4:
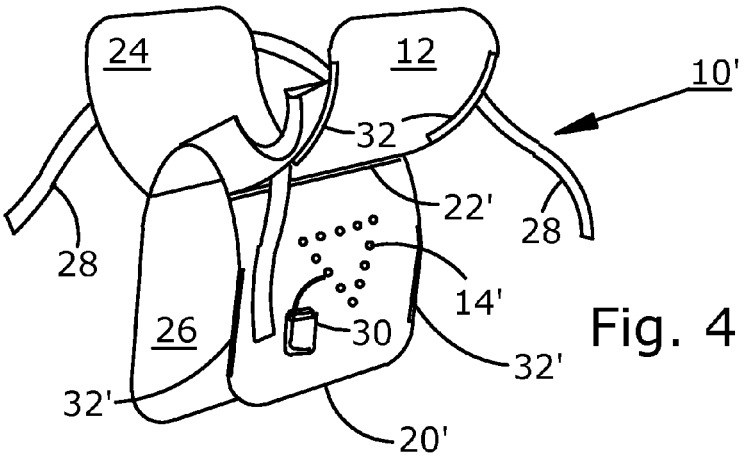
FIG. 4 is a front perspective view of the safety body cover of FIG. 3 with a front inner panel having a different light pattern installed.

Referring now to FIG. 4, the safety body cover of the invention is now identified as body cover 10', having been converted by assembly of inner front panel 20' bearing a different light pattern 14'. The initial step of assembling an inner panel to body cover 10' is to align and engage top fastener 22'. Outer front panel 12 is then pressed to inner front panel 20' and outer panel side fasteners 32 engaged with inner panel side fasteners 32' to secure the front panels to one another. If the light pattern mounted to inner rear panel 26 is also to be changed, a similar procedure is conducted.

Figure 5:
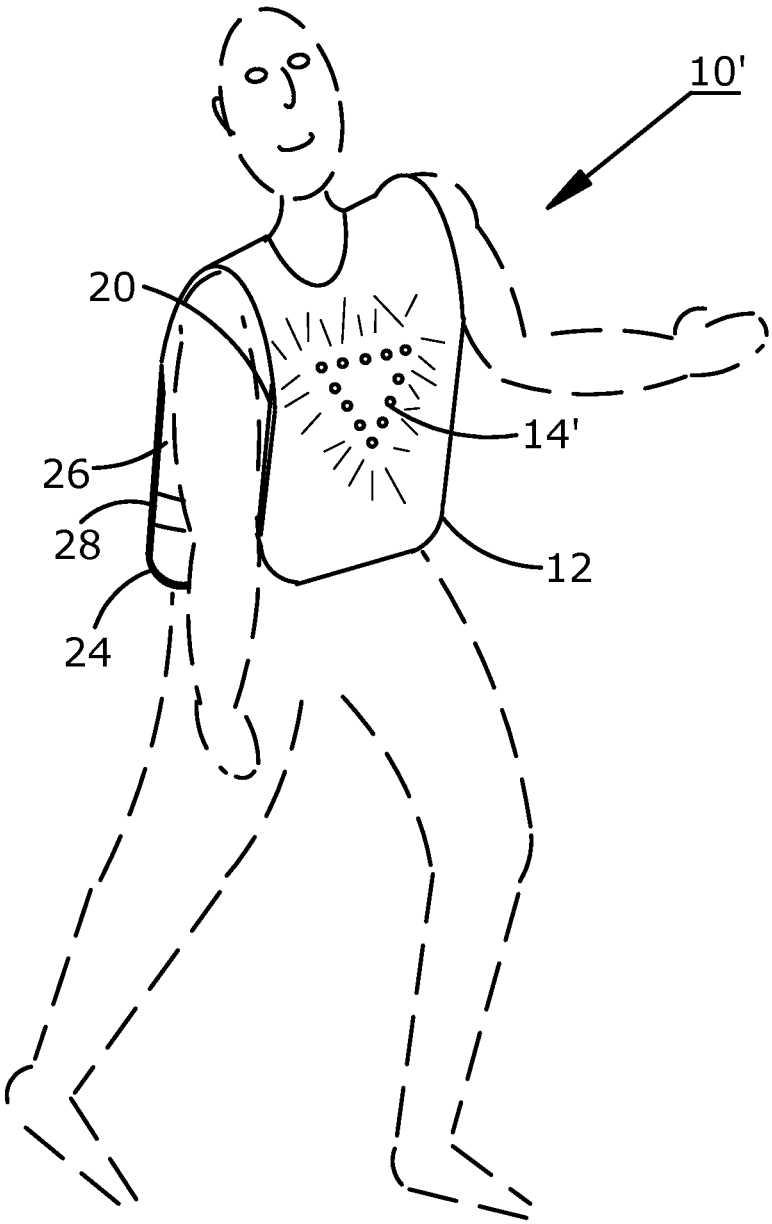
FIG. 5 is a front perspective view of the convertible safety body cover of FIG. 4 being worn and illuminated.

Referring now to FIG. 5, safety body cover 10' is shown being worn by a person doing exercise. Alternate light pattern 14' is seen illuminated behind semi-transparent outer front panel 12. A second light pattern (not shown) is also illuminated and visible through outer rear panel 24, the rear visibility of a person exercising in a road area with low light conditions being of major importance. Closure straps 28 are attached to maintain safety body cover 10' securely and comfortably on the user.

As noted above, the light pattern may be formed as geometric shapes, artistic renderings, letters, numbers, and any combination. This versatility provides the safety body cover user the ability to select a light pattern by personal preference. It is also possible to supply the safety body cover with a plurality of light patterns, e.g. to select a first light pattern for jogging alone, and select a different light pattern for exercising with a group, the light pattern optionally may display a group logo or an advertisement and worn by all members of the group.

While the description above discloses preferred embodiments of the present invention, it is contemplated that numerous variations and modifications of the invention are possible and are considered to be within the scope of the claims that follow.

What is claimed is:

1. A convertible safety body cover, comprising:

a. an outer front panel having a top end;

b. an outer rear panel having a top end, the top end of the outer rear panel connected to the top end of the outer front panel;

c. an inner front panel removeably mounted to the outer front panel;

d. an inner rear panel removeably mounted to the outer rear panel;

e. a first power supply mounted to the inner front panel; and f. a first light pattern mounted to the inner front panel, the first light pattern connected to the first power supply.

2. The convertible safety body cover described in claim 1, further comprising a transparent protective sheet mounted to the inner front panel in a manner to enclose the first light pattern.

3. The convertible safety body cover described in claim 1, further comprising a second power supply mounted to the inner rear panel and a second light pattern mounted to the inner rear panel, the second light pattern connected to the second power supply.

4. The convertible safety body cover described in claim 3, further comprising a transparent protective sheet mounted to the inner rear panel in a manner to enclose the second light pattern.

5. The convertible safety body cover described in claim 1, wherein the outer front panel and the outer rear panel are formed of semi-transparent sheet material.

6. The convertible safety body cover described in claim 1, wherein the first light pattern is formed of an array of LEDs.

7. The convertible safety body cover described in claim 3, wherein the second light pattern is formed of an array of LEDs.

* * * * *